US008068773B2

(12) United States Patent
Uehashi

(10) Patent No.: US 8,068,773 B2
(45) Date of Patent: Nov. 29, 2011

(54) DEVELOPMENT DEVICE AND IMAGE FORMING APPARATUS

(75) Inventor: Tetsuya Uehashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 437 days.

(21) Appl. No.: 12/323,623

(22) Filed: Nov. 26, 2008

(65) Prior Publication Data

US 2009/0142109 A1 Jun. 4, 2009

(30) Foreign Application Priority Data

Nov. 29, 2007 (JP) ..... 2007-308879

(51) Int. Cl.
*G03G 15/08* (2006.01)

(52) U.S. Cl. ..... 399/288

(58) Field of Classification Search ..... 399/288
See application file for complete search history.

(56) References Cited

U.S. PATENT DOCUMENTS 7,801,470 B2 * 9/2010 Minegishi et al. ..... 399/288
2003/0026629 A1 * 2/2003 Kawamura et al. ..... 399/283

FOREIGN PATENT DOCUMENTS

JP 2002-108090 A 4/2002

* cited by examiner

*Primary Examiner* — David Gray
*Assistant Examiner* — Erika J Villaluna
(74) *Attorney, Agent, or Firm* — Panitch Schwarze Belisario & Nadel LLP

(57) ABSTRACT

A development device includes a developer carrier and a developer supply belt. The developer carrier, disposed in contact with an image carrier carrying an electrostatic latent image, carries developer to be charged with a prescribed polarity and develops the electrostatic latent image by application of development voltage. The developer supply belt includes a first roller, a second roller, and a belt. The belt is tightly stretched by the first roller and the second roller, and is disposed in contact with the developer carrier from a contact beginning portion to a contact finishing portion. A potential difference between the development voltage and the voltage of the contact finishing portion is arranged to be zero (0) V or above and 600 V or below.

14 Claims, 4 Drawing Sheets

DEVELOPMENT DEVICE AND IMAGE FORMING APPARATUS

BACKGROUND OF THE INVENTION

1. Field of the Invention

The present invention relates to a development device and an image forming apparatus.

2. Description of Related Art

In a related-art image forming apparatus such as a printer, a photocopier, a facsimile machine, and a multi-functional peripheral employing an electrophotographic method, for example, the related-art printer performs processes of charging, exposing, developing, transferring, cleaning, and discharging in a vicinity of a photosensitive drum. A toner image formed on the photosensitive drum is transferred to and fixed on a sheet serving as a medium.

In such a related-art printer, the developing process is performed by a development device that includes a development roller developing an electrostatic latent image formed on the photosensitive drum by adhesion of toner and a toner supply roller not only supplying the toner to the development roller and but also scraping residual toner remained on the development roller after the developing process. Japanese Unexamined Patent Application Publication No. 2002-108090 discloses such a toner supply roller to which voltage is applied so as to supply the toner to the development roller.

In such a related-art development device, since an electric field is formed by the voltage so as to adhere charged toner to the development roller, the residual toner remained on the development roller is not adequately scraped. Consequently, the residual toner remained on the development roller in a previous developing process is used for a next developing process, causing generation of a residual image on the sheet. Such a residual image causes deterioration of an image quality.

It is an object of the present invention to provide a development device and an image forming apparatus capable of reducing the residual image on the medium and enhancing the image quality.

BRIEF SUMMARY OF THE INVENTION

According to one aspect of the invention, a development device includes: a developer carrier, disposed in contact with an image carrier carrying an electrostatic latent image, carrying developer to be charged with a prescribed polarity and developing the electrostatic latent image by application of development voltage; and a developer supply belt. The developer supply belt includes: a first roller; a second roller; and a belt, tightly stretched by the first roller and the second roller, being disposed in contact with the developer carrier from a contact beginning portion to a contact finishing portion. A potential difference between the development voltage and the voltage of the contact finishing portion is arranged to be zero (0) V or above and 600 V or below.

According to another aspect of the present invention, an image forming apparatus includes: an image carrier carrying an electrostatic latent image; and the above described development device developing the electrostatic latent image carried by the image carrier.

Additional features and advantages of the present invention will be more fully apparent from the following detailed description of embodiments, the accompanying drawings and the associated claims.

BRIEF DESCRIPTION OF THE DRAWINGS

A more complete appreciation of the aspects of the invention and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
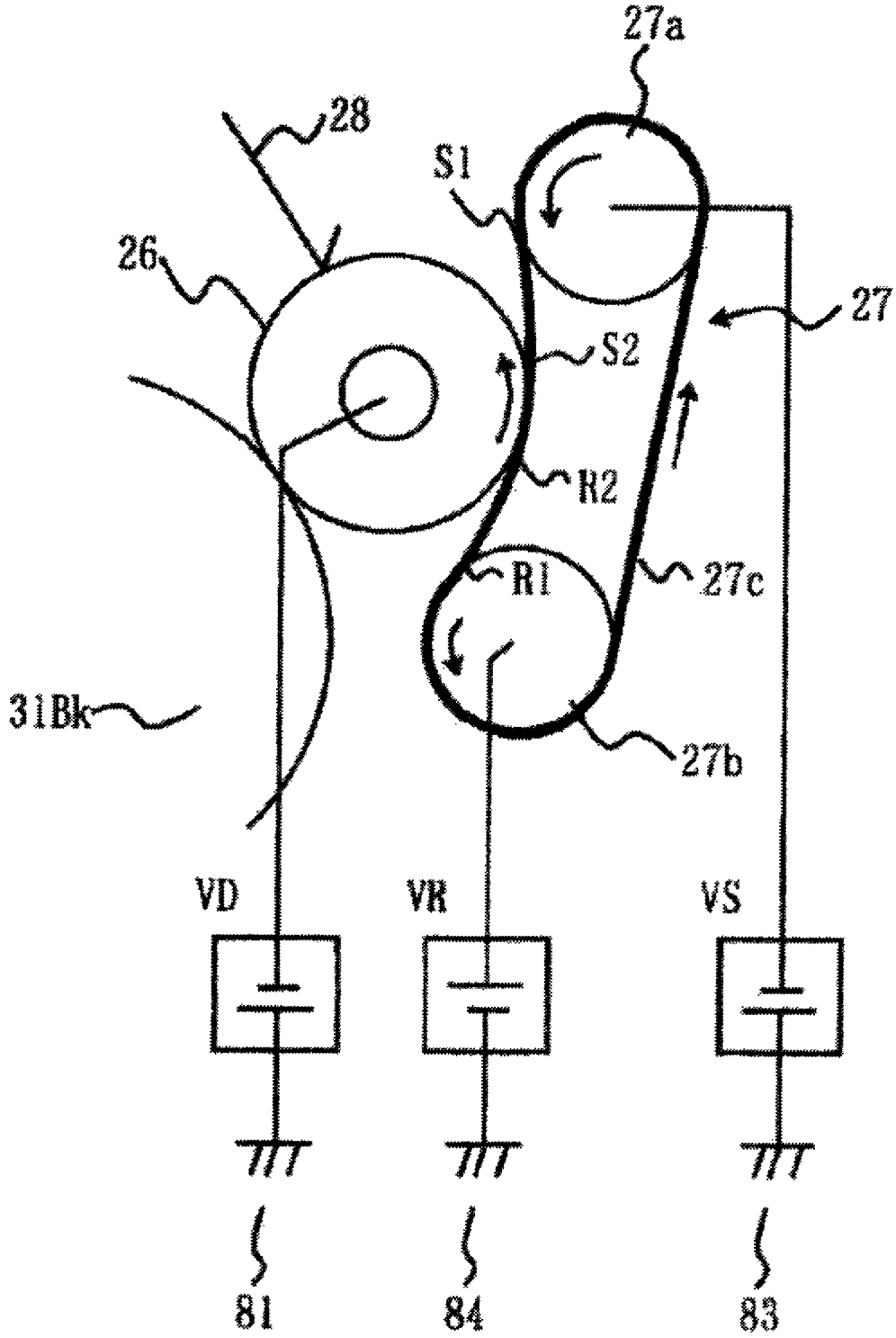
FIG. 1 is a schematic diagram illustrating a development device according to a first embodiment of the present invention.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, a printer serving as an image forming apparatus according to a first embodiment of the present invention is described, and like reference numerals designate identical or corresponding parts throughout the several views.

Figure 2:
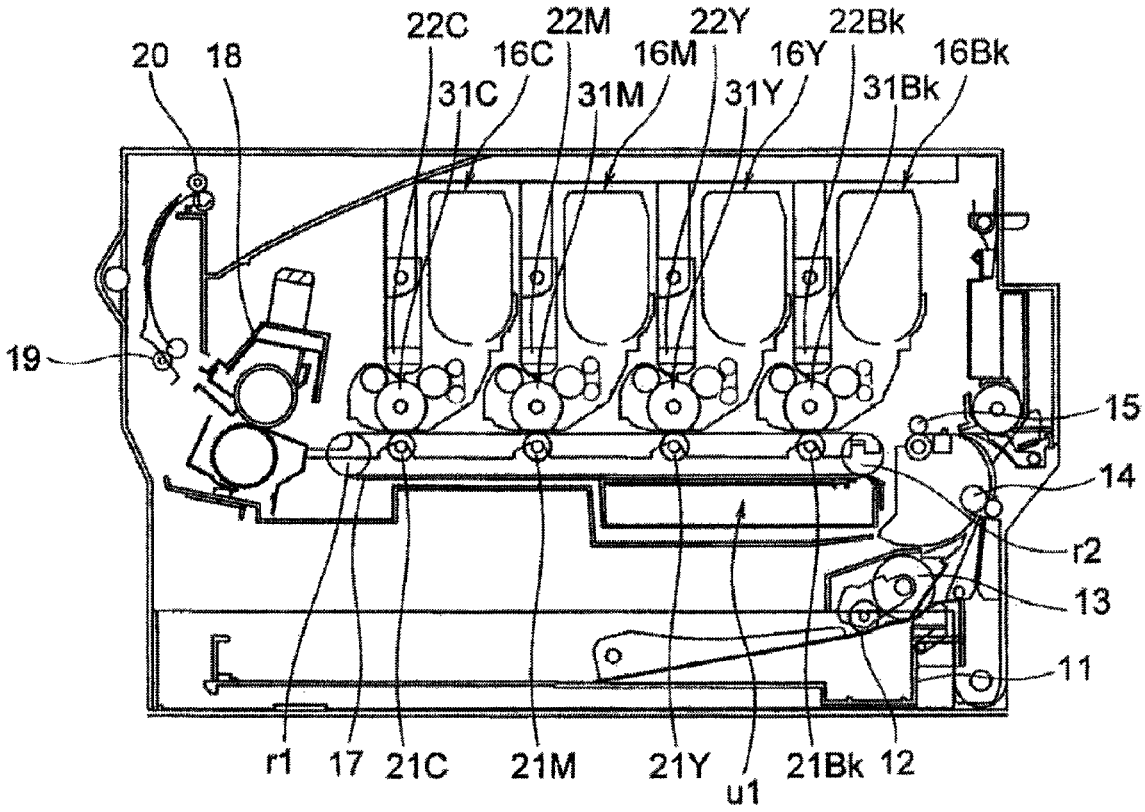
FIG. 2 is a schematic diagram illustrating a printer serving as an image forming apparatus according to the first embodiment of the present invention.

Referring to FIG. 2, the printer according to the first embodiment of the present invention is illustrated.

As illustrated in FIG. 2, the printer includes a sheet feed cassette 11 serving as a medium storage unit disposed in a lower portion thereof, and the sheet feed cassette 11 stores a sheet of paper (not shown) serving as a medium therein. A sheet feed mechanism is disposed adjacent to one end of the sheet feed cassette 11, and separates a plurality of sheets one by one to separately feed each sheet. The sheet feed mechanism includes a feed roller 12 and a separation roller 13. Upon reception of a print command transmitted from a host device (not shown), a control unit (not shown) controls to rotate the feed roller 12 and the separation roller 13, so that the plural sheets are separated one by one, and each of the sheets is fed from the sheet feed cassette 11. The sheet fed from the sheet cassette 11 is fed to a conveyance roller 14 disposed above the feed roller 12 and the separation roller 13. After the sheet is further fed to the a conveyance roller 15, the sheet is supplied to image forming units 16Bk, 16Y, 16M, and 16C serving as image forming members each of which forms an image of black, yellow, magenta, and cyan, respectively.

The image forming units 16Bk, 16Y, 16M, and 16C respectively include photosensitive drums 31Bk, 31Y, 31M, and 31C serving as image carriers. Light Emitting Diode (LED) heads 22Bk, 22Y, 22M, and 22C serving as light writing devices and as exposure devices are disposed adjacent to respective image forming units 16Bk, 16Y, 16M, and 16C, and are disposed opposite to respective photosensitive drums 31Bk, 31Y, 31M, and 31C. When the LED heads 22Bk, 22Y, 22M, and 22C expose surfaces of the photosensitive drums 31Bk, 31Y, 31M, and 31C, respectively based on image data transmitted from the host device, each of the photosensitive drums 31Bk, 31Y, 31M, and 31C forms an electrostatic latent image as a latent image on a surface thereof. The photosensitive drums 31Bk, 31Y, 31M, and 31C carry the electrostatic latent images formed thereon.

A transfer unit u1 is disposed along the image forming units 16Bk, 16Y, 16M, and 16C, and includes a drive roller r1, a driven roller r2, a conveyance belt 17 serving as a conveyance member, and transfer rollers 21Bk, 21Y, 21M, and 21C serving as transfer members. The conveyance belt 17 is disposed travelably and is tightly stretched by the drive roller r1 and the driven roller r2. The transfer rollers 21Bk, 21Y, 21M, and 21C are disposed opposite to the photosensitive drums 31Bk, 31Y, 31M, and 31C, respectively, and the transfer rollers 21Bk, 21Y, 21M, and 21C and the photosensitive drums 31Bk, 31Y, 31M, and 31C sandwich the conveyance belt 17 therebetween.

The sheet is conveyed with the travel of the conveyance belt 17, and passes each of areas between the image forming units 16Bk, 16Y, 16M, and 16C and the transfer rollers 21Bk, 21Y, 21M, and 21C, so that each of toner images as developer images of respective colors formed by the image forming units 16Bk, 16Y, 16M, and 16C is sequentially superimposed and transferred to the sheet by respective transfer rollers 21Bk, 21Y, 21M, and 21C, thereby forming a multi-color toner image.

Subsequently, the sheet is fed to a fixing device 18 serving as a fixing apparatus. In the fixing device 18, the multi-color toner image is fixed onto the sheet by application of heat and pressure, thereby forming a multi-color image. The fixing device 18 includes a fixing roller serving as a first fixing roller and a pressure roller serving as a second fixing roller. The fixing roller includes a halogen lamp serving as a heat member therein, and the pressure roller is pressed against the fixing roller. The sheet is then conveyed by a conveyance roller 19, and is ejected outside the printer by a conveyance roller 20.

Now, a description is given of the image forming units 16Bk, 16Y, 16M, and 16C. Since the image forming units 16Bk, 16Y, 16M, and 16C are substantially similar to one another except for the color of toner 35, one image forming unit 16Bk is described with reference to FIG. 3 as a representative of all the image forming units 16Bk, 16Y, 16M, and 16C.

Figure 3:
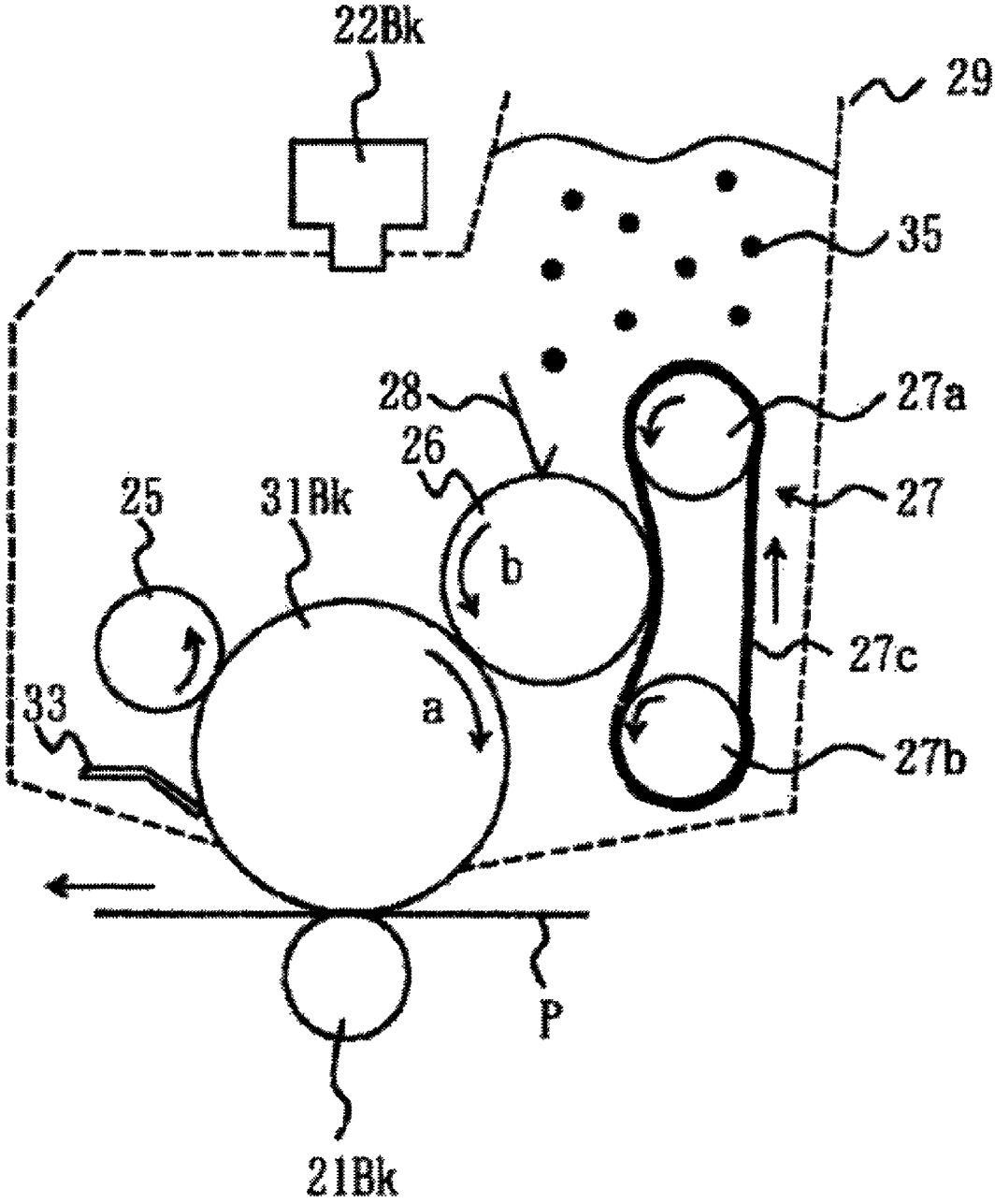
FIG. 3 is a schematic diagram illustrating an image forming unit according to the first embodiment of the present invention.

Referring to FIG. 3, the image forming unit 16Bk according to the first embodiment of the present invention is illustrated.

The image forming unit 16Bk includes a development roller 26 serving as a developer carrier, a toner supply belt 27 serving as a developer supply belt, a development blade 28 serving as a developer regulation member, a toner cartridge 29 serving as a developer cartridge. The development roller 26 is disposed in contact with the photosensitive drum 31Bk, carries a toner 35 serving as the developer, and is rotated in a direction indicated by an arrow "b" shown in FIG. 3. The toner supply belt 27 supplies the toner 35 to the development roller 26. The development blade 28 forms a thin layer of the toner 35 on the development roller 26. The toner cartridge 29 contains the toner 35 which is not yet used. A development device (described later) serving as a development apparatus includes the development roller 26, the toner supply belt 27, the development blade 28, the toner cartridge 29, and the like. The toner supply belt 27 includes a drive roller 27*a* serving as a first roller, a driven roller 27*b* serving as a second roller, and a belt 27*c*. Each of the drive roller 27*a* and the driven roller 27*b* is made of, for example, a metallic material having a high conductivity. The belt 27*c* is tightly stretched by the drive roller 27*a* and the driven roller 27*b*, and travels in a direction indicated by an arrow shown in FIG. 3 with rotation of the drive roller 27*a*.

The photosensitive drum 31Bk includes a photoreceptor serving as a surface layer made of an organic optical semiconductor. A charging roller 25 serving as a charging device applies an electric charge to the photoreceptor, and uniformly charges the surface of the photosensitive drum 31Bk with approximately −600 V. Accordingly, the charging roller 25 is applied with direct-current voltage having a negative polarity. The charging roller 25 is rotated as rotation of the photosensitive drum 31Bk so as to reduce a surface wearing amount of the photoreceptor. The LED head 22Bk forms the electrostatic latent image on the surface of the photosensitive drum 31Bk using an LED element serving as a light source. A laser may be used as a substitute for the LED head 22Bk.

The development roller 26 is rotated, with the rotation of the photosensitive drum 31Bk in a direction indicated by an arrow "a," in a direction indicated by the arrow "b" shown in FIG. 3 as the opposite direction while contacting or being adjacent to the photosensitive drum 31Bk, so that the electrostatic latent image on the photosensitive drum 31Bk is developed, thereby forming the toner image. When the toner image formed on the photosensitive drum 31Bk is transferred to a sheet P by the transfer roller 21Bk, the sheet P is conveyed in a direction indicated by an arrow as illustrated in FIG. 3. Subsequently, the sheet having the toner image thereon is conveyed to the fixing device 18 in which the toner image is fixed thereon. A cleaning blade 33 serving as a cleaning member employing a blade method removes the toner 35 remained on the photosensitive drum 31Bk after the toner image is transferred to the sheet P. Such a toner 35 is referred to as residual toner 35.

Referring to FIG. 1, the development device according to the first embodiment of the present invention is illustrated.

The development roller 26 is made of a metal shaft that is coated with an elastic layer. The elastic layer is made of an elastic member such as silicone rubber and urethane rubber, and has a volume resistivity of approximately $10^8$ Ωcm or above and $10^{12}$ Ωcm or below. A coat layer may be formed on a surface layer of the development roller 26. According to the first embodiment, the development roller 26 has a diameter of 20 mm.

The development blade 28 is made of a sheet metal having elasticity. A tip of the development blade 28 is bent and contacts the surface of the development roller 26 with prescribed pressure.

The belt 27*c* is made of chloroprene rubber and the like, and has a volume resistivity of approximately $10^4$ Ωcm or above and $10^7$ Ωcm or below. The belt 27*c* is made in such a manner to have a surface roughness Rz of 5 μm or above and 15 μm or below. The belt 27*c* has a thickness of 0.2 mm or above and 0.8 mm or below. The belt 27*c* may be made of semiconductive urethane resin, polyimide resin, polyimide-amide resin, urethane rubber, CR rubber, silicone rubber, and the like as a substitute for the chloroprene rubber. In a case where the belt 27*c* is made of any of such substitute materials, the belt 27*c* is made in such a manner to have a volume resistivity of approximately $10^4$ Ωcm or above and $10^7$ Ωcm or below and the surface roughness Rz of 5 μm or above and 15 μm or below.

The belt 27*c* travels in a direction indicated by an arrow shown in FIG. 1 with the rotation of the drive roller 27*a*. The driven roller 27*b* is rotationally driven with the travel of the belt 27*c*. Accordingly, the driven roller 27*b* is urged in a downward direction (i.e., in a direction away from the drive roller 27*a*) by a coil spring (not shown) serving as an urging member, and a tension strength of 500 gram-weight or above and 3,000 gram-weight or below is generated to the belt 27*c*.

The belt 27*c* contacts the development roller 26 in such a manner that a contact width (also referred to as a nip width) between the belt 27*c* and the development roller 26 in a middle portion between the drive roller 27*a* and the driven roller 27*b* to be 4 mm or above and 20 mm or below. The drive roller 27*a* moves the belt 27*c* by the rotation of the drive roller 27*a* and is rotated in the same direction as the development roller 26 in such a manner that the belt 27*c* has a speed ratio of 0.2 or above and 1.0 or below with respect to the development roller 26. Consequently, an outer circumference of the development roller 26 and a surface of the belt 27*c* are moved in the direction opposite to each other in a portion at which the development roller 26 and the belt 27*c* contact each other.

In a travel direction, the belt 27*c* is separated from the drive roller 27*a* at a separation portion S1, contacts the driven roller 27*b* at a contact portion R1, begins to contact the development roller 26 at a contact beginning portion S2, and finishes contacting the development roller 26 at a contact finishing portion R2. In other words, the belt 27*c* contacts the development roller 26 from the contact beginning portion S2 to the contact finishing portion R2.

The drive roller 27*a* undergoes a sandblast process on a surface thereof to increase travelability of the belt 27*c*. The drive roller 27*a* may have a coating layer on a surface layer thereof or may undergo a knurl process as a substitute for the sandblast process.

One-component toner is used as the toner 35. Such toner 35 as illustrated in FIG. 3 is made of toner including a resin component such as polyester and polystyrene, a coloring agent, a releasing agent, and a charging control agent, and an external additive agent such as silica that is added to a surface layer of the toner. The toner 35 is made by a grind method or a polymerization method. The toner 35 has a volume mean powder diameter of 3 μm or above and 10 μm or below, and has a mean sphericity ϕ of 0.90 or above and 0.98 or below.

The mean sphericity ϕ of the toner 35 is calculated by division of a sum total of sphericity of toner particles by a number of the toner particles. Here, a number of toner detection particles to be measured are 3,500. The mean sphericity ϕ is measured by a flow particle image analyzer (FPIA-2000 available from Sysmex Corporation). The mean sphericity ϕ represents an index indicating a degree of roughness of the toner 35, and is expressed as follows. Mean sphericity ϕ=(diameter of circle which is substantially equal to a particle projection area)/(a diameter of the smallest circle circumscribing to a particle projected image)

In a case where the toner 35 is a perfect sphere, the mean sphericity ϕ is 1.00. The more complicated the surface shape of the toner 35 becomes, the smaller the value of the mean sphericity ϕ. The particle projection area represents an area of a binarized toner particle image, and a circumference length of the particle projection image represents a contour line length that is obtained by connecting edge points of the toner particle image.

The toner 35 is adjusted by the charging control agent, the external additive agent, and the like in such a manner that a charging amount (μQ/g) becomes −60 (μQ/g) or above and −20 (μQ/g) or below in a case where the charging amount (μQ/g) is measured by a blow-off method. The blow-off method is a measurement method for measuring an amount of charge toner. A high-voltage power source 81 applies voltage VD as development voltage to the development roller 26, a high-voltage power source 83 applies voltage VS as first voltage to the drive roller 27*a*, and a high-voltage power source 84 applies voltage VR as second voltage to the driven roller 27*b*. Here, for example, the voltage VS, the voltage VD, and the voltage VR are arranged to be −450 V, −200 V, and +300 V, respectively.

In operation of the above structure of the development device, when the print command is transmitted from the host device, and image forming operation begins, a drive motor (not shown) serving as a drive unit begins to drive, thereby rotating each of the photosensitive drum 31Bk, the development roller 26, and the drive roller 27*a*. With the rotation of the drive roller 27*a*, the belt 27*c* travels with adhering the toner 35 in a vicinity thereof to the surface thereof. Here, adhesion force of the toner 35 with respect to the belt 27*c* is generated by Van der Waals's force and relatively small Coulomb force provided by the surface roughness Rz of the belt 27*c*. Moreover, the toner 35 is charged with a prescribed polarity by an agitation member and the like (not shown). In this embodiment, for example, the toner 35 is charged with a negative polarity (by triboelectric charge), and the adhesion force may be generated by electrostatic force.

The toner 35 adhered to the belt 27*c* is conveyed with the travel of the belt 27*c*, and contacts the development roller 26 at the contact beginning portion S2.

As described above, the drive roller 27*a* and the driven roller 27*b* are applied with the voltage VS and the voltage VR, respectively. Since the volume resistivity of the belt 27*c* is smaller than that of the development roller 26, voltage, at which a potential difference between the voltage VS and the voltage VR is resistively divided by a distance from the separation portion S1 to the contact beginning portion S2 and a distance from the contact beginning portion S2 to the contact portion R1, is generated at the contact beginning portion S2. Also, voltage, at which a potential difference between the voltage VS and the voltage VR is resistively divided by a distance from the separation portion S1 to the contact finishing R2 and a distance from the contact finishing portion R2 to the contact portion R1, is generated at the contact finishing portion R2.

Therefore, where a distance L1 from the separation portion S1 to the contact portion R2 is arranged to be 20 mm, where a distance L2 from the separation portion S1 to the contact beginning portion S2 to be arranged to be 4 mm, where a distance L3 from the contact beginning portion S2 to the contact finishing portion R2 is arranged to be 12 mm, and where a distance L4 from the contact finishing portion R2 to the contact portion R1 is arranged to be 4 mm, voltage V1, at which the potential difference VT between the voltage VS and the voltage VR is resistively divided by the distance L2 from the separation portion S1 to the contact beginning portion S2 and a distance from the contact beginning portion S2 to the contact portion R1 (i.e., distance L3+distance L4), is generated at the contact beginning portion S2. In other words, the potential difference VT between the voltage VS and the voltage VR is calculated as follows:

$$VT=300-(-450)=750\text{ V}$$

Since the potential difference VT is calculated to be 750 V, the voltage V1 of the contact beginning portion S2 is calculated as follows:

$$V1=-450+750\times(4/20)=-300\text{ V}$$

Here, since the voltage V1 of the contact beginning portion S2 is high in a negative direction with respect to voltage VD of −200 V to be applied to the development roller 26, an electric field is formed for moving the toner 35 charged with the negative polarity to the development roller 26. Therefore, the toner 35 is moved to and adhered to the development roller 26 by the electric field.

The toner 35 adhered to the development roller 26 is formed into a uniform thin layer when passing through the development blade 28 with the rotation of the development roller 26. Upon passing through the development blade 28, the toner 35 contacts the photosensitive drum 31Bk and develops the electrostatic latent image on the photosensitive drum 31Bk.

Moreover, voltage V2, at which the potential difference VT between the voltage VS and VR is resistively divided by a distance from the separation portion S1 to the contact finishing portion R2 (i.e., the distance L2+the distance L3) and the distance L4 from the contact finishing portion R2 to the contact portion R1, is generated at the contact finishing portion R2. That is, since the potential difference VT between the voltage VS and VR is 750 V, the voltage V2 at the contact finishing portion R2 is calculated as follows:

$$V2=300-750\times(4/20)=150\text{ V}$$

Therefore, the voltage V1 to be generated at the contact beginning portion S2 on the belt 27*c* is provided with the negative polarity which is the same as the charging polarity of the toner 35. The voltage V2 to be generated at the contact finishing portion R2 on the belt 27*c* is provided with a positive polarity which is opposite to the voltage V1.

Here, since the voltage V2 of the contact finishing portion R2 has a positive value with respect to the voltage VD of −200 V to be applied to the development roller 26, an electric field is formed for collecting the toner charged with the negative polarity in the tone supply belt 27, so that the toner 35 is moved to the belt 27 and is adhered to the toner supply belt 27 by the electric field. The toner 35 adhered to the belt 27*c* is conveyed to the contact finishing portion S2.

In this way, the toner supply belt 27 repeatedly supplies and collects the toner 35 with respect to the development roller 26.

Where the voltage V1 of the contact beginning portion S2 is arranged in such a manner that the toner 35 charged with the negative polarity is moved to the development roller 26 by variations in each of the voltage VS, VR, and VD and each of distances L1 through L4, and where the voltage V2 of the contact finishing portion R2 is arranged in such a manner that the toner 35 charged with the negative polarity is collected in the toner supply belt 27, a valuation result of the image formation is shown in TABLE 1.

TABLE 1

| | | | | | | | | | | |
|---|---|---|---|---|---|---|---|---|---|---|
| VOLTAGE VR | 0 | 200 | 362 | 400 | 600 | 800 | 1000 | 1112 | 1200 | 1400 |
| VOLTAGE V2 | −90 | +70 | +200 | +230 | +390 | +550 | +710 | +800 | +870 | +1030 |
| POTENTIAL DIFFERENCE | −290 | −130 | 0 | 30 | 190 | 350 | 510 | 600 | 670 | 830 |
| RESIDUAL IMAGE | X | X | ○ | ○ | ○ | ○ | ○ | ○ | X | X |

Here, each of the distances L1 through L4 is substantially equal to the description given above. The voltage VS is fixed at −450 V, and the voltage VD is fixed at −200 V. The voltage VR is varied between zero (0) V to 1,400 V. Accordingly, the potential difference between the voltage VD and the voltage V2 of the contact finishing portion R2 is calculated.

A rate of a collection amount of the toner 35 from the development roller 26 to the toner supply belt 27 is measured with respect to an adhesion amount of the toner 35 on the development roller 26. In a case where the collection amount of the toner 35 is adequate while generating no residual image, a circle "○" is marked in TABLE 1. In a case where the collection amount of the toner 35 is not adequate while having a likelihood of generating the residual image, an "x" is marked in TABLE 1.

Where the voltage VR is arranged in such a manner that the potential difference becomes zero (0) V or above, the residual image is not formed on the sheet. Where the voltage VR is arranged in such a manner that the potential difference becomes higher than 600 V, a potential of a toner layer formed on the belt 27*c* increases in the course of printing a solid image. Subsequently, the toner 35 having the high potential is re-supplied to the development roller 26, causing an increase in a likelihood of generating the residual image on the sheet P.

According to the first embodiment, the voltage VR is arranged in such a manner that the potential difference between the voltage VD and the voltage V2 generated at the contact finishing portion R2 becomes zero (0) V or above and 600 V or below, so that the electric field is formed in the contact finishing portion R2 for moving the toner 35 to the toner supply belt 27 from the development roller 26, thereby collecting the residual toner 35. Therefore, the likelihood of generating the residual image on the sheet P can be reduced, and the image quality can be enhanced.

Figure 4:
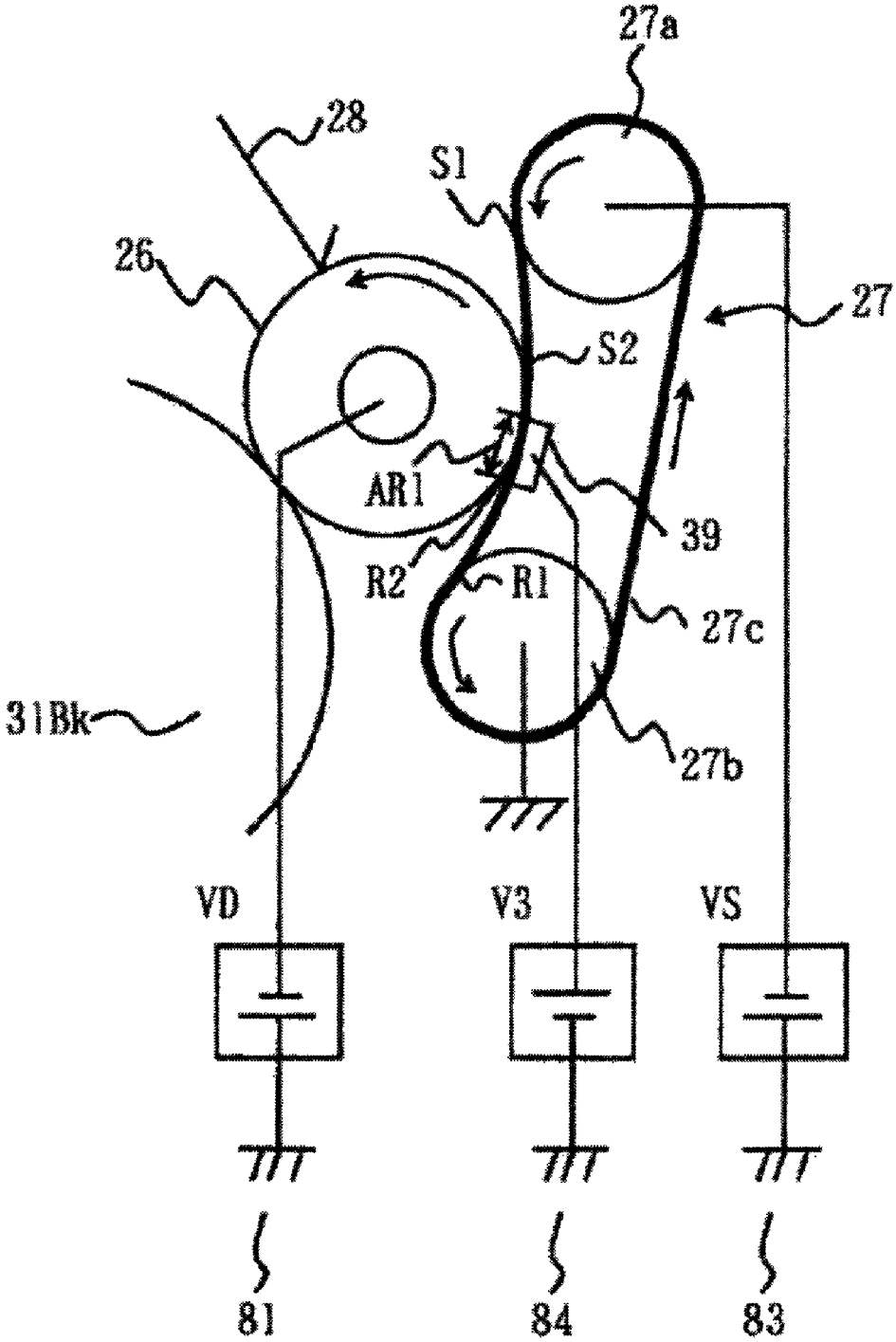
FIG. 4 is a schematic diagram illustrating a development device according to a second embodiment of the present invention.

Now, a description is given of a second embodiment of the present invention with reference to FIG. 4. A components, an element, and a configuration that are similar to the first embodiment will be given the same reference numerals as above and description thereof will be omitted.

Referring to FIG. 4, a development device according to the second embodiment of the present invention is illustrated.

A toner collection electrode 39 serving as an electrode member is made of metal and the like having a conductive electrode. The toner collection electrode 39 contacts a backside of a belt 27*c* in a region AR1 in a toner supply belt 27 in such a manner that the region AR1 contacting with the belt 27*c* includes a contact finishing portion R2. Here, a driven roller 27*b* serving a second roller is grounded, the toner collection electrode 39 is applied with voltage V3 serving as third voltage, and voltage of the contact finishing portion R2 is arranged in the voltage V3.

According to the second embodiment, voltage VS and voltage VD are fixed at −450 V and −200 V, respectively, and voltage of contact beginning portion S2 is arranged to be V1 as similar to the first embodiment.

The potential difference between the voltage VD to be applied to a development roller 26 serving as a developer carrier and the voltage V3 of the contact finishing portion R2 is arranged in such a manner to be zero (0) V or above and 600 V or below. For example, the voltage V3 is arranged to be +150 V.

In operation of the development device, as similar to the first embodiment, the voltage V1 of the contact beginning portion S2 is high in a negative direction with respect to voltage VD to be applied to the development roller 26. Consequently, an electric field is formed for moving toner 35 serving as developer being charged with a negative polarity to the development roller 26, so that the toner 35 is moved to and adhered to the development roller 26 by the electric field.

Since the voltage V3 of the contact finishing portion R2 has a positive value with respect to the voltage VD to be applied to the development roller 26, an electric field is formed for collecting the toner 35 charged with the negative polarity in the tone supply belt 27, so that the toner 35 is moved to the toner supply belt 27 and is adhered to the belt 27*c* by the electric field. The toner 35 adhered to the belt 27*c* is conveyed to the contact finishing portion S2.

For example, where the voltage V3 is arranged to be zero (0) V, the voltage of the contact finishing portion R2 becomes zero (0) V, so that the toner 35 charged with the negative polarity is collected from the development roller 26 to the toner supply belt 27. The region AR1 is formed across a prescribed distance, thereby reducing an occurrence of conveying the residual toner 35 remained adhering to the development roller 26 to the photosensitive drum 31Bk by passing through the development roller 26 and the region AR1. Therefore, a likelihood of generating the residual image on the sheet P as the medium can be further reduced.

According to the second embodiment, a magnitude relation between the volume resistivity of the development roller 26 and the belt 27*c*, and a resistive division and the like in the toner supply belt 27 may not necessarily considered.

According to each of the first and the second embodiments described above, the toner 35 to be charged with the negative polarity is used. Alternatively, toner to be charged with a positive polarity may be used as the toner 35. In such an alternative case, for example, the voltages VS, VD, VR and V3 are arranged to be +450 V, +200 V, −300 V, and −150 V, respectively.

According to each of the first and the second embodiments, the color printer is described as the image forming apparatus. Alternatively, the embodiments of the present invention may be applied to a monochrome printer employing an electrophotographic method using a photosensitive drum. Moreover, the embodiments of the present invention may be applied to a photocopier, a facsimile machine, a multi-functional peripheral, and the like.

As can be appreciated by those skilled in the art, numerous additional modifications and variation of the present invention are possible in light of the above-described teachings. It is therefore to be understood that, within the scope of the appended claims, the disclosure of this patent specification may be practiced otherwise than as specifically described herein.

What is claimed is:

1. A development device comprising:

a developer carrier, disposed in contact with an image carrier carrying an electrostatic latent image, carrying developer to be charged with a prescribed polarity and developing the electrostatic latent image by application of a development voltage; and a developer supply belt, comprising:

a first roller;

a second roller; and a belt, tightly stretched by the first roller and the second roller, being disposed in contact with the developer carrier from a contact beginning portion to a contact finishing portion, wherein a potential difference between the development voltage and a voltage of the contact finishing portion is arranged to be zero V or above and 600 V or below, wherein the first roller is applied with a first voltage, and wherein the second roller is applied with a second voltage.

2. The development device according to claim 1, comprising an electrode member being contacted with the belt at a backside of the belt in a region including the contact finishing portion, and wherein the electrode member is applied with a third voltage.

3. The development device according to claim 1, wherein voltage generated at the contact beginning portion on the belt is arranged to have the same polarity as a charging polarity of the developer, and wherein voltage generated at the contact finishing portion on the belt is arranged to have the opposite polarity to the charging polarity of the developer.

4. The development device according to claim 1, wherein the contact beginning portion and the contact finishing portion are located at prescribed distances away from the first and second rollers respectively.

5. A development device comprising:

a developer carrier, disposed in contact with an image carrier carrying an electrostatic latent image, carrying developer to be charged with a prescribed polarity and developing the electrostatic latent image by application of a development voltage; and a developer supply belt, comprising:

a first roller;

a second roller; and a belt, tightly stretched by the first roller and the second roller, being disposed in contact with the developer carrier from a contact beginning portion to a contact finishing portion, wherein a potential difference between the development voltage and a voltage of the contact finishing portion is arranged to be zero V or above and 600 V or below, and wherein a volume resistivity of the developer carrier is arranged to be greater relative to a volume resistivity of the belt.

6. The development device according to claim 5, wherein the volume resistivity of the developer carrier is arranged to be $10^8$ Ωcm or above and $10^{12}$ Ωcm or below, and wherein the volume resistivity of the belt is arranged to be $10^4$ Ωcm or above and $10^7$ Ωcm or below.

7. The development device according to claim 5, wherein the contact beginning portion and the contact finishing portion are located at prescribed distances away from the first and second rollers respectively.

8. An image forming apparatus comprising:

an image carrier carrying an electrostatic latent image; and a development device developing the electrostatic latent image carried by the image carrier, the development device comprising:

a developer carrier, disposed in contact with the image carrier carrying the electrostatic latent image, carrying developer to be charged with a prescribed polarity and developing the electrostatic latent image by application of a development voltage; and a developer supply belt, comprising:

a first roller;

a second roller; and a belt, tightly stretched by the first roller and the second roller, being disposed in contact with the developer carrier from a contact beginning portion to a contact finishing portion, wherein a potential difference between the development voltage and a voltage of the contact finishing portion is arranged to be zero V or above and 600 V or below, wherein the first roller is applied with a first voltage, and wherein the second roller is applied with a second voltage.

9. The image forming apparatus according to claim 8, comprising an electrode member being contacted with the belt at a backside of the belt in a region including the contact finishing portion, and wherein the electrode member is applied with third voltage.

10. The image forming apparatus according to claim 8, wherein voltage generated at the contact beginning portion on the belt is arranged to have the same polarity as a charging polarity of the developer, and wherein voltage generated at the contact finishing portion on the belt is arranged to have the opposite polarity to the charging polarity of the developer.

11. The development device according to claim 8, wherein the contact beginning portion and the contact finishing portion are located at prescribed distances away from the first and second rollers respectively.

12. An image forming apparatus comprising:

an image carrier carrying an electrostatic latent image; and a development device developing the electrostatic latent image carried by the image carrier, the development device comprising:

a developer carrier, disposed in contact with the image carrier carrying the electrostatic latent image, carrying developer to be charged with a prescribed polarity and developing the electrostatic latent image by application of a development voltage; and a developer supply belt, comprising:

a first roller;

a second roller; and a belt, tightly stretched by the first roller and the second roller, being disposed in contact with the developer carrier from a contact beginning portion to a contact finishing portion, wherein a potential difference between the development voltage and a voltage of the contact finishing portion is arranged to be zero V or above and 600 V or below, and wherein a volume resistivity of the developer carrier is arranged to be greater relative to a volume resistivity of the belt.

13. The image forming apparatus according to claim 12, wherein the volume resistivity of the developer carrier is arranged to be $10^8$ Ωcm or above and $10^{12}$ Ωcm or below, and wherein the volume resistivity of the belt is arranged to be $10^4$ Ωcm or above and $10^7$ Ωcm or below.

14. The development device according to claim 12, wherein the contact beginning portion and the contact finishing portion are located at prescribed distances away from the first and second rollers respectively.

* * * * *